US008591129B2

(12) United States Patent
Chan

(10) Patent No.: US 8,591,129 B2
(45) Date of Patent: Nov. 26, 2013

(54) LIPSTICK ASSEMBLY HAVING AUTOMATIC CAP

(75) Inventor: Lin-Lang Chan, Taichung (TW)

(73) Assignee: Shya Hsin Plastic Works Co., Ltd., Taichung (TW)

( * ) Notice: Subject to any disclaimer, the term of this patent is extended or adjusted under 35 U.S.C. 154(b) by 64 days.

(21) Appl. No.: 13/427,848

(22) Filed: Mar. 22, 2012

(65) Prior Publication Data

US 2013/0058701 A1 Mar. 7, 2013

(30) Foreign Application Priority Data

Sep. 6, 2011 (TW) ..... 100216609 U

(51) Int. Cl.
*B43K 5/16* (2006.01)

(52) U.S. Cl.
USPC ..... 401/108; 401/107; 401/78

(58) Field of Classification Search
USPC ..... 401/107, 108, 75, 77, 78, 98
See application file for complete search history.

(56) References Cited

U.S. PATENT DOCUMENTS 5,037,227 A * 8/1991 Kakuta et al. ..... 401/60
6,315,479 B1 * 11/2001 Sakurai ..... 401/59
7,637,371 B2 * 12/2009 Kang ..... 206/385
8,267,606 B2 * 9/2012 Delbove et al. ..... 401/78

* cited by examiner

*Primary Examiner* — David Walczak
(74) *Attorney, Agent, or Firm* — Leong C. Lei

(57) ABSTRACT

The lipstick assembly has an outer tube, a middle tube, a rotational control base, and a lipstick base. A vertical groove is configured on an inner surface of the outer tube for joining and confining the middle tube to move only up and down. Helical grooves are configured separately in an upper section and a lower section on an inner surface of the middle tube. The lower helical groove is joined to the rotational control base whereas the upper helical groove is joined to the lipstick base. When the rotational control base is twisted in one direction, the middle tube is raised upward to force a cap of the outer tube to open. Then, by twisting the rotational control base in an opposite direction, the middle tube is retracted and the cap automatically seals the lipstick assembly.

5 Claims, 5 Drawing Sheets

LIPSTICK ASSEMBLY HAVING AUTOMATIC CAP

(A) TECHNICAL FIELD OF THE INVENTION

The present invention is generally related to lipsticks, and more particular to a lipstick assembly having a cap that automatically opens when the lipstick is raised and automatically closes when the lipstick is retracted.

(B) DESCRIPTION OF THE PRIOR ART

A conventional lipstick assembly has an outer tube threaded by a middle tube which in turn conceals a lipstick base that is raised or retracted by the twisting of a rotational control base along pre-configured grooves on the inner surface of the middle tube. The top opening of the lipstick assembly is usually covered by a removable and separate cap so that the lipstick is protected inside the lipstick assembly. This independent cap would cause some inconvenience in the application of the lipstick. To apply the lipstick, the cap has to be removed and kept separately. It is quite often that the cap is misplaced as such and the lipstick cannot be carried safely.

SUMMARY OF THE INVENTION

Therefore, a novel lipstick assembly with an automatically open and close cap is provided herein. According to the present invention, helical grooves are configured along the inner surfaces of the middle tube so that the middle tube and the lipstick base are raised and retracted sequentially by the twisting of the rotational control base along different directions. And, in the process, the cap is automatically opened by the middle tube and closed by the resilience of an elastic element.

More specifically, a vertical groove is configured on an inner surface of the outer tube for joining and confining the middle tube to move only up and down. On the other hand, the helical grooves are configured separately in an upper section and a lower section on an inner surface of the middle tube. The lower helical groove is joined to the rotational control base whereas the upper helical groove is joined to the lipstick base. As such, when the rotational control base is twisted in one direction, the middle tube is raised upward to force the cap to open. Subsequently, the lipstick base is raised upward to expose the lipstick for convenient application. Then, by twisting the rotational control base in an opposite direction, the lipstick base and the middle tube are retracted and, in the process, the cap automatically seals the lipstick assembly to protect the lipstick inside.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
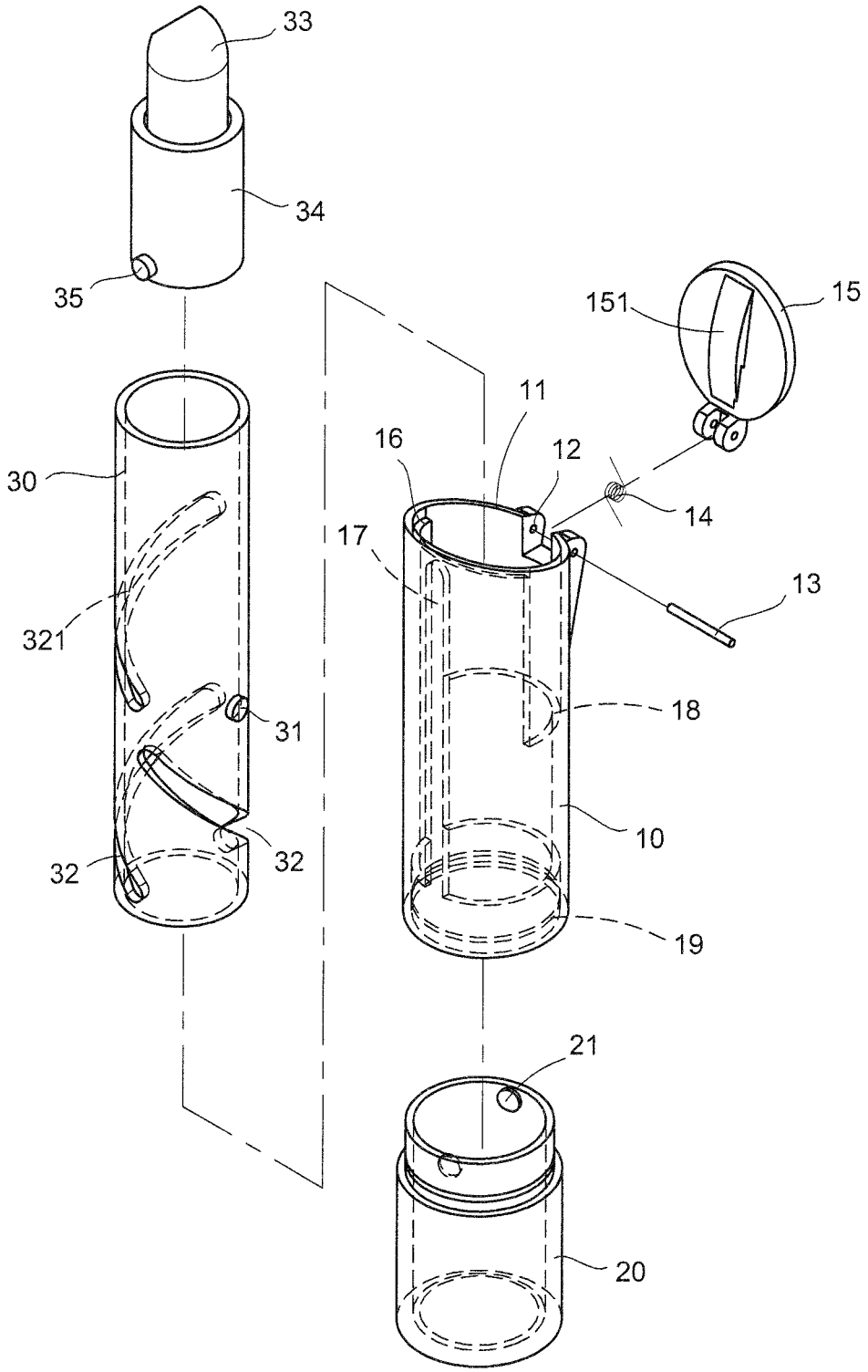
FIG. 1 is a break-down diagram showing the various components of a lipstick assembly according to an embodiment of the present invention.
Figure 2:
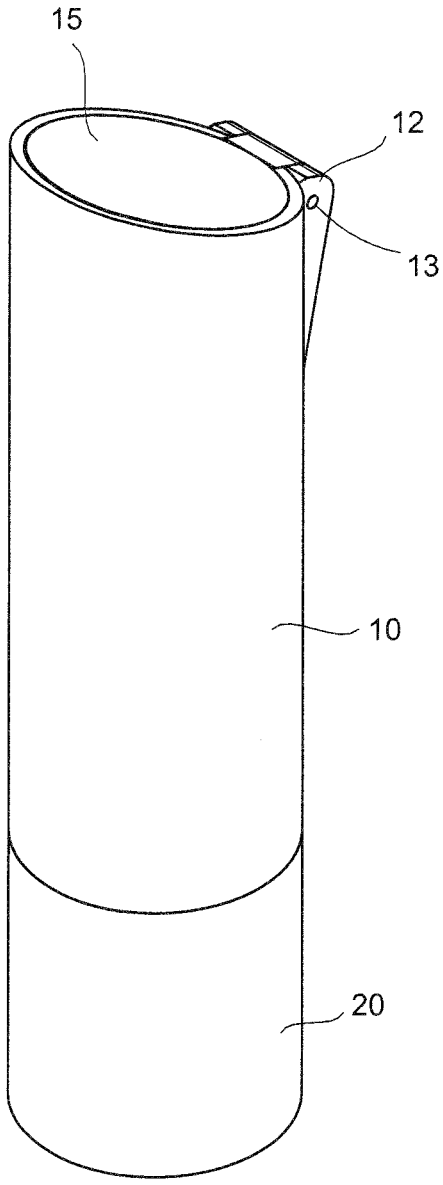
FIG. 2 is a perspective diagram showing the lipstick assembly of FIG. 1 when it is assembled.
Figure 3:
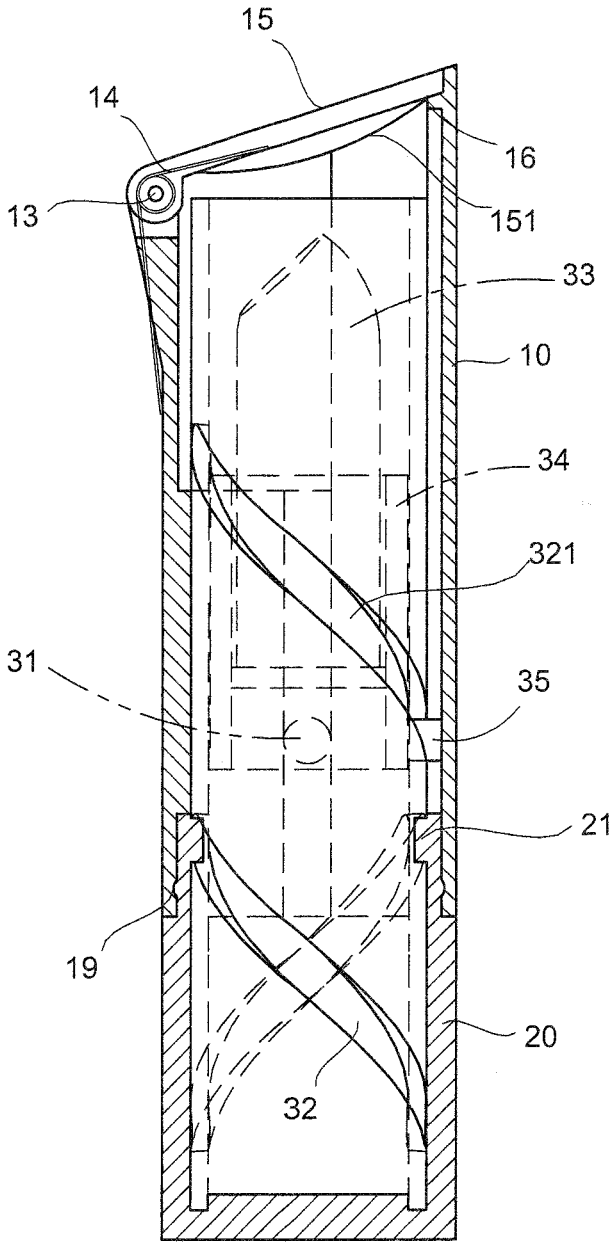
FIG. 3 is a sectional diagram showing f the lipstick assembly of FIG. 1 when the lipstick is entirely concealed.
Figure 4:
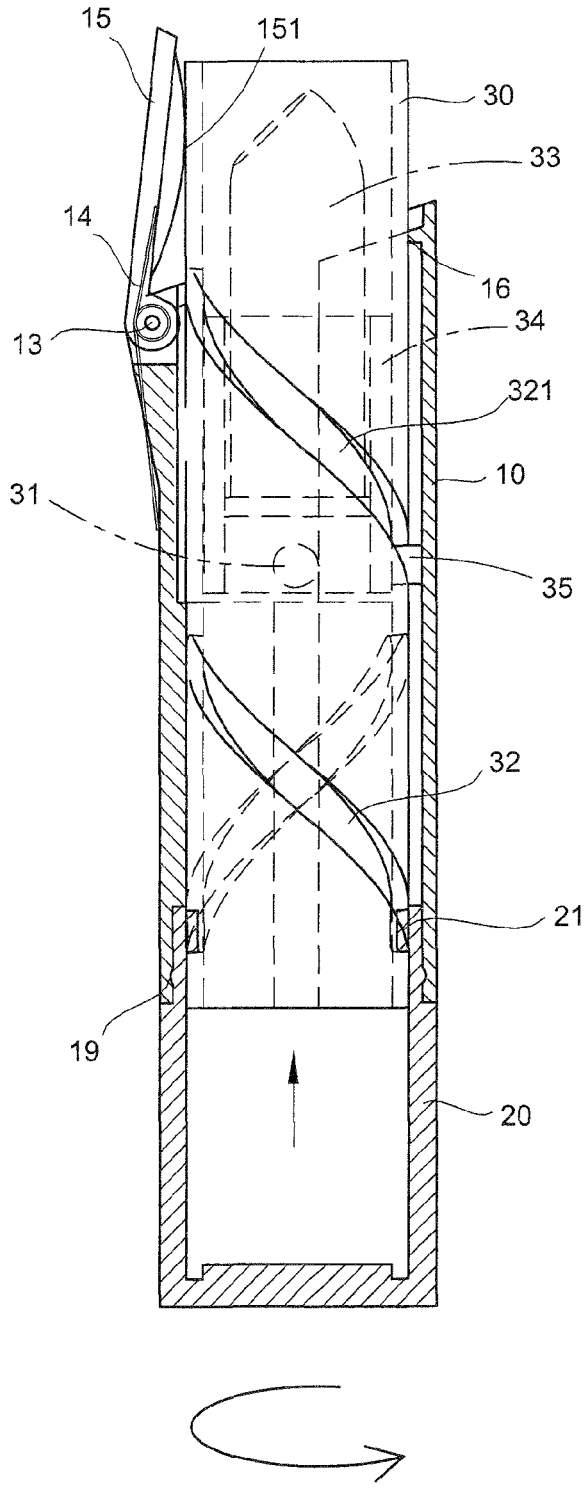
FIG. 4 is a sectional diagram showing f the lipstick assembly of FIG. 1 when the cap is automatically opened.
Figure 5:
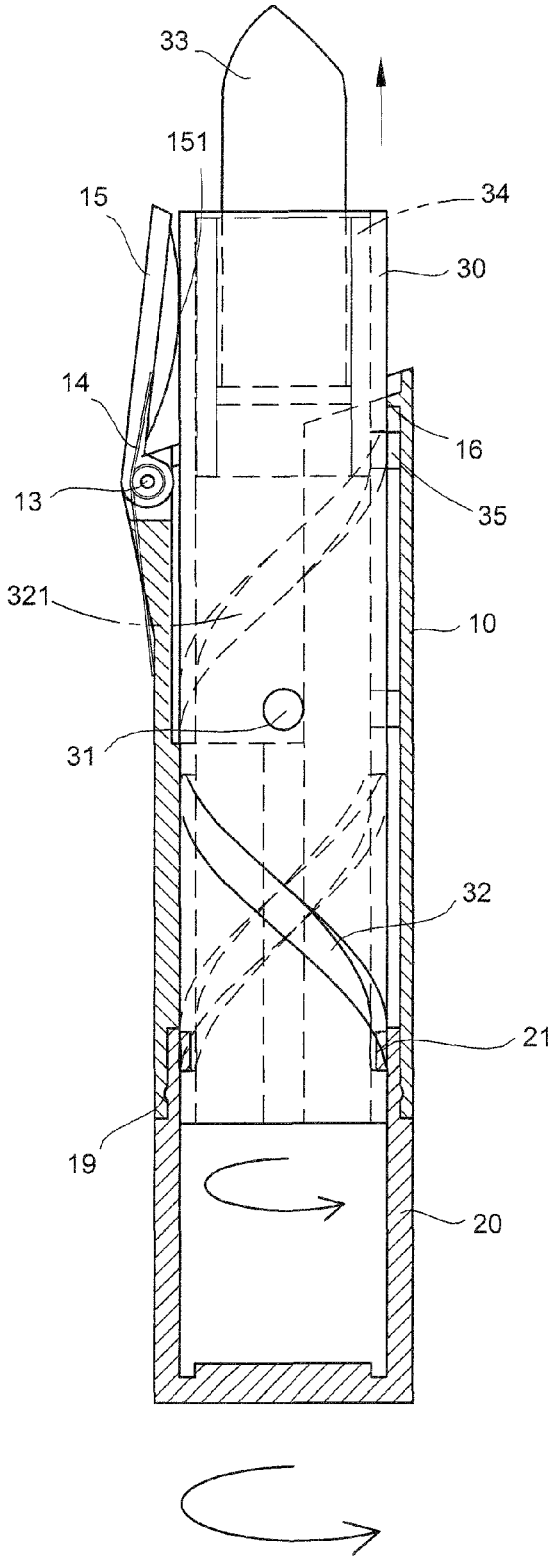
FIG. 5 is a sectional diagram showing f the lipstick assembly of FIG. 1 when the lipstick is raised.

As shown in FIGS. 1 to 5, a lipstick assembly according to an embodiment of the present invention has an outer tube 10 with a flat bottom end and a top end of a slant cross-sectional surface 11. The slant top end is sealed by a cap 15 which is pin-jointed to a pivotal base 12 at a lower section on the opening of the top end by an elastic element 14 and a pin 13 threading through the elastic element 14. When the cap 15 is closed to seal the top end of the outer tube 10, a stopping protrusion 16 on the inner surface of the outer tube 10 across the pivotal base 12 prevents the cap 15 from sinking into the outer tube 10. A curved bulge 151 for reinforcement and opening the cap 15 runs across a bottom side of the cap 15. Along the inner surface of the outer tube 10, there are a vertical groove 17 and a semi-circular indentation 18 in an upper section of the outer tube 10's inner surface. Additionally, a ring groove 19 is configured adjacent to the bottom end of the outer tube 10. A rotational control base 20 has two opposing protrusions 21 on the inner surface of the rotational control 20's top end, which is plugged into a middle tube 30 which has a protrusion 31 in a middle section of its outer surface. In a lower section of the middle tube 30's inner surface, there are two lower helical grooves 32. In an upper section of the middle tube 30's outer surface, there is an upper helical groove 321 for joining to a lipstick base 34 having a lipstick 33 threading into a top end of the lipstick base 34 and a protrusion 35 on the outer surface adjacent to a bottom end of the lipstick base 34. The rotational control base 20's top end is inserted over the bottom end of the middle tube 30 with the protrusions 21 embedded into the helical grooves 32 of the middle tube 30. The lipstick base 34 is embedded into the top end of the middle tube 30 with the protrusion 35 embedded into the upper helical groove 321. The jointed lipstick base 34, the middle tube 30, and the rotational control base 20 are then threaded into the bottom end of the outer tube 10 with the middle tube 30's protrusion 31 embedded in the vertical groove 17 of the outer tube 10. The height of the protrusion 31 of the middle tube 30 is slightly lower than the height of the protrusion 35 of the lipstick base 34.

The operation of the lipstick assembly is as follows. A user uses one hand to hold the outer tube 10 and uses the other hand to twist the rotational control base 20 along a direction. The two protrusions 21 of the rotational control base 20 moves along the lower helical grooves 32 of the middle tube 30. Since the middle tube 30's protrusion 31 is confined in the outer tube 10's vertical groove 17, the middle tube 30 does not turn but can only move upward. As the rotational control base 20 is continuously twisted, the middle tube 30 touches the curved bulge 151 and drives the cap 15 open by stretching the elastic element 14. The cap 15 is therefore automatically opened. As the twisting of the rotational control base 20 is continued, the middle tube 30's protrusion 31 is moved out of the vertical groove 17 and into the semi-circular indentation 18. As such, the middle tube 30 starts to rotate along with the rotational control base 20. The lipstick base 34's protrusion 35 then moves along the upper helical groove 321 and the lipstick base 34 rises upward. The lipstick 33 is as such exposed out of the outer tube 10 for convenient application. Due to the curved bulge 151 under the cap 15, the cap 15 is further pushed outward by the middle tube 30 so that the cap 15 does not get in the way of the application of the lipstick 33. To retract the lipstick 33, the rotational control base 20 is twisted along an opposite direction and the lipstick 33 and the middle tube 30 sequentially descend into the outer tube 10. When the top end of the middle tube 30 reaches the slant surface 11 of the outer tube 10, the cap 15 is restored to seal the outer tube 10 by the resilience of the elastic element 14. The automatic open and close of the cap 15 achieves convenient and practical application and carry of the lipstick assembly.

The greatest feature of the lipstick assembly of the present invention is that the lipstick 33's exposure and retraction is solely controlled by the twisting of the rotational control base 20. The user is as such freed from the actions of removing and restoring the cap 15. To apply the lipstick 33, the cap 15 will be opened automatically and, after application, the elastic element 14 automatically restores the cap 15 and the lipstick 33 is concealed safely.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lipstick assembly, comprising:

an outer tube having a cap sealing a top opening of said outer tube, said cap pin-joined to a rim of said top opening, a vertical groove configured along an inner surface of said outer tube, a semi-circular indentation in an upper section of said inner surface;

a middle tube having a protrusion in a middle section of an outer surface of said middle tube, an upper helical groove in an upper section of an inner surface of said middle tube, at least a lower helical groove in a lower section of said outer surface of said middle tube;

a lipstick base having a lipstick threading into a top end of said lipstick base and a protrusion on an outer surface adjacent to a bottom end of said lipstick base, said lipstick base inserted into a top end of said middle tube with said protrusion of said lipstick base embedded into said upper helical groove; and a rotational control base having at least a protrusion on an inner surface of said rotational control base; said rotational control base plugged over a bottom end of said middle tube with said protrusion of said rotational control base embedded into said lower helical groove;

wherein the joined lipstick base, said middle tube, and said rotational control base are threaded into a bottom end of said outer tube with said protrusion of said middle tube embedded into said vertical groove of said outer tube; and, when said rotational control base is twisted along a direction, said middle tube is raised to push said cap open and, subsequently, said lipstick base is raised outside of said outer tube.

2. The lipstick assembly according to claim 1, wherein said top opening of said outer tube has a slant cross-sectional surface.

3. The lipstick assembly according to claim 1, wherein said cap's pin-joining to said outer tube is configured with an elastic element for closing said cap automatically.

4. The lipstick assembly according to claim 1, wherein said cap has a curved bulge across a bottom side of said cap.

5. The connector assembly according to claim 1, wherein the height of said protrusion of said middle tube is slightly lower than the height of said protrusion of said lipstick base.

* * * * *